US005414498A

United States Patent [19]

Buchan et al.

[11] Patent Number: 5,414,498

[45] Date of Patent: May 9, 1995

[54] LIQUID/DRY TONER IMAGING SYSTEM

[75] Inventors: William R. Buchan, Pocasset; Robert A. Moore, Waquoit, both of Mass.; Sotos M. Theodoulou, Bramalea, Canada; Jeffrey J. Carrish, Milford, Mass.

[73] Assignee: Delphax Systems, Canton, Mass.

[21] Appl. No.: 121,078

[22] Filed: . Sep. 14, 1993

[51] Int. Cl.[6] ..... G03G 15/10; G03G 15/01

[52] U.S. Cl. ..... 355/256; 355/279

[58] Field of Search ..... 355/256, 279; 346/157

[56] References Cited

U.S. PATENT DOCUMENTS

| | | | |
|---|---|---|---|
| 3,767,300 | 10/1973 | Brown et al. | 355/297 |
| 3,983,815 | 10/1976 | Borelli | 101/426 |
| 4,141,317 | 2/1979 | Lakhani | 118/661 |
| 4,161,141 | 4/1979 | Lakhani | 101/1 |
| 4,582,774 | 4/1986 | Landa | 430/126 |
| 4,690,539 | 9/1987 | Radulski et al. | 355/3 TR |
| 4,708,460 | 11/1987 | Langdon | 355/10 |
| 5,012,291 | 4/1991 | Buchan et al. | 355/271 |
| 5,028,964 | 7/1991 | Landa et al. | 355/273 |
| 5,045,425 | 9/1991 | Swidler | 430/115 |
| 5,047,808 | 9/1991 | Landa et al. | 355/277 |
| 5,053,823 | 10/1991 | Oh-ishi et al. | 355/256 |
| 5,069,995 | 12/1991 | Swidler | 430/115 |
| 5,103,263 | 4/1992 | Moore et al. | 355/212 |
| 5,106,710 | 4/1992 | Wang et al. | 430/42 |
| 5,200,285 | 4/1993 | Carrish | 430/45 |
| 5,285,244 | 2/1994 | Bujese | 355/256 |

FOREIGN PATENT DOCUMENTS

| | | |
|---|---|---|
| WO91/03006 | 3/1991 | WIPO . |
| WO92/10793 | 6/1992 | WIPO . |

*Primary Examiner*—Joan H. Pendegrass
*Attorney, Agent, or Firm*—Lahive & Cockfield

[57] ABSTRACT

An imaging system, or unit of an imaging system, and a method of imaging employing a single imaging member to form a liquid-toned image, to condition the image, and to transfuse it to a print-receiving medium. The member moves through three sections, with the image formed in the first section, then changing state in each successive section. In a preferred embodiment, a heat exchanger uses heat from the third section to extract the liquid carrier from the toned image while it is in the second section. Condensed carrier replenishes toner, cooling the first section. Multicolor printing is effected by employing several such units, one for each color, to transfuse colored images in succession onto a receiving member.

18 Claims, 2 Drawing Sheets

LIQUID/DRY TONER IMAGING SYSTEM

BACKGROUND OF THE INVENTION

The present invention relates to imaging systems of the type wherein a latent charge image is formed on an imaging member, the latent charge image is developed by a toner, and the developed image is transferred to a receiving member to form a permanent image. Numerous systems of this type exist in the prior art, wherein the latent image may be formed by optical or electrical means, and the pigmented toner maybe a liquid toner or a dry powder toner.

Any such system is subject to broad limitations that may affect system performance.

Liquid-toned images, for example, may become blurred or distorted during transfer, and may also require special coated papers so as not to soak into, or through, the receiving member. Undesirable wicking along paper fibers may degrade the final image, and environmental concerns are raised by the presence of vapors from the toner carrier, which is transferred to the imaging member and partially removed during a fusing step. On the other hand, suspension of the pigment particles in a liquid carrier allows a high degree of process uniformity, and permits the use of very fine toner particles, so that extremely faithful images may be produced when specialized processors or recording sheets permit operation, generally at relatively low speeds, where no squeegee or pressurized wet image transfer steps are involved.

In like manner, dry toners are convenient to handle, and are essentially free of vapor emissions, but they present other limitations related to their development mechanics. The use of generally larger toner particles in dry toners is necessary to limit environmental dust, but can give dry-toned images of low density a grainy appearance; and the mechanical application by cascade or a brush rotating along the sheet feed direction may give rise to small directional artifacts, such as streamers, in the final image. Furthermore, development efficiency can become extremely variable as the components of a multi-part developer vary, or as weather conditions that affect charging or transfer of toner, change.

As demands for greater speed or resolution, or decreased environmental impact, are placed upon such imaging machines, each kind of process is increasingly challenged, and no one design can be expected to simultaneously optimize operating cost, cleanliness, resolution, speed, mechanical simplicity and component lifetime.

Among the greatest problems in such imaging mechanisms are those of forming a toned image, keeping it stable, and transferring this image to the ultimate print sheet (or fixing it on the sheet, in those specialized systems in which the ultimate sheet is directly developed) with speed and good image quality.

In a liquid toned system, transfer to the final sheet may be accomplished by direct contact, in which the liquid and toner particles are simply wicked into the partially absorbent receiving surface. In a powder toned system, the powder-developed image may be transferred by a high pressure nip, or may be transferred by providing electrostatic field at the nip or gap with an imaging roller. Often, specialized intermediate transfer belts or drums are used to pick up the toned image from the latent imaging member and then release it to a recording sheet. Fusing of the transferred image may be accomplished later by applying heat, pressure or both.

Some systems extend across different ones of the above categories. For example, commonly-owned U.S. Pat. Nos. 5,012,291 and 5,103,263 show a single-belt system wherein a powdered toner is applied to the imaging belt and then brought to a high temperature or even liquified state before being brought into contact with a receiving sheet. U.S. Pat. No. 4,708,460 shows a system where a liquid-toned image is transferred to an intermediate belt 34 that carries it through a heater station, partially vaporizing the carrier and softening the toner particles before the liquid image is transferred and fused at a hot pressure nip, which vaporizes substantially all the remaining carrier liquid. A somewhat similar system intended for multicolor printing is shown in U.S. Pat. No. 4,690,539, wherein liquid images of successive colors are transferred to an intermediate belt on which the carrier is removed by a vacuum system, thus stabilizing the toners on the belt before transferring the dried toner images to a copy sheet. In each of these latter systems, much of the carrier is removed before the image is transferred to a final recording sheet.

U.S. Pat No. 5,106,710 shows a system wherein one or more liquid toner images are applied to a dielectric-coated paper with a thin release coating. The toned image passes a vacuum squeegee, and is air dried after which the toner image is transferred to a receiving sheet in a heated roller nip or on a hot platen in a vacuum draw-down frame.

Other processes have been proposed several decades ago wherein liquid toners are partially or fully dried, as part of a multicolor liquid-toned process, on an imaging member, and recently very specific systems have evolved, such as the one shown in international application WO91/03006 wherein an intermediate roller member is used to pick up a liquid-toned image, heat it and transfer to a recording sheet.

SUMMARY OF THE INVENTION

In accordance with the present invention, a single imaging member receives a latent image and is developed at a first station with a liquid toner to form a toned image on the member. The member then moves into an enclosure in which its temperature is raised and a carrier liquid from the toner undergoes a phase change to leave a dry toned image on the member, after which the heated dry toner is transferred by direct contact and fused to a receiving member. The liquid toner is a carrier having hard thermoplastic toner particles suspended in the carrier, with a charge director. The particles are non-swelling in the carrier, so that evaporation of the carrier leaves a dry friable but captive powder image on the imaging member. Preferably the member is a belt that moves over rollers at each end; and the heating enclosure surrounds a central portion of belt, where a heat exchanger scavenges heat from a returning dry portion of the belt to evaporate carrier from the toned wet portion of the belt as it travels toward the transfuse station. The belt is inextensible, but includes a relatively compressible elastomeric layer which allows it to conform when transferring the heated powder image to diverse print objects, such as cans or packaging, wallpaper, or other articles or sheets on which an image is to be printed. Preferably the belt is non-swelling and resistant to the carrier. A solvent barrier may be formed at the belt surface, by coating, applying crosslinking energy, or otherwise, to protect the belt from absorbing carrier.

In one embodiment, the enclosure is connected to pass carrier vapor to a condenser that condenses liquid carrier and returns it to the toning system. Preferably the belt includes a continuous ground plane, and the latent image is formed by directing charged particles in an imagewise pattern at the belt, to which they are drawn by an electric field established by the ground plane potential.

BRIEF DESCRIPTION OF THE DRAWINGS

These and other features of the invention will be more fully understood from the following description, taken together with illustrative drawings, wherein.

DETAILED DESCRIPTION

Figure 1:
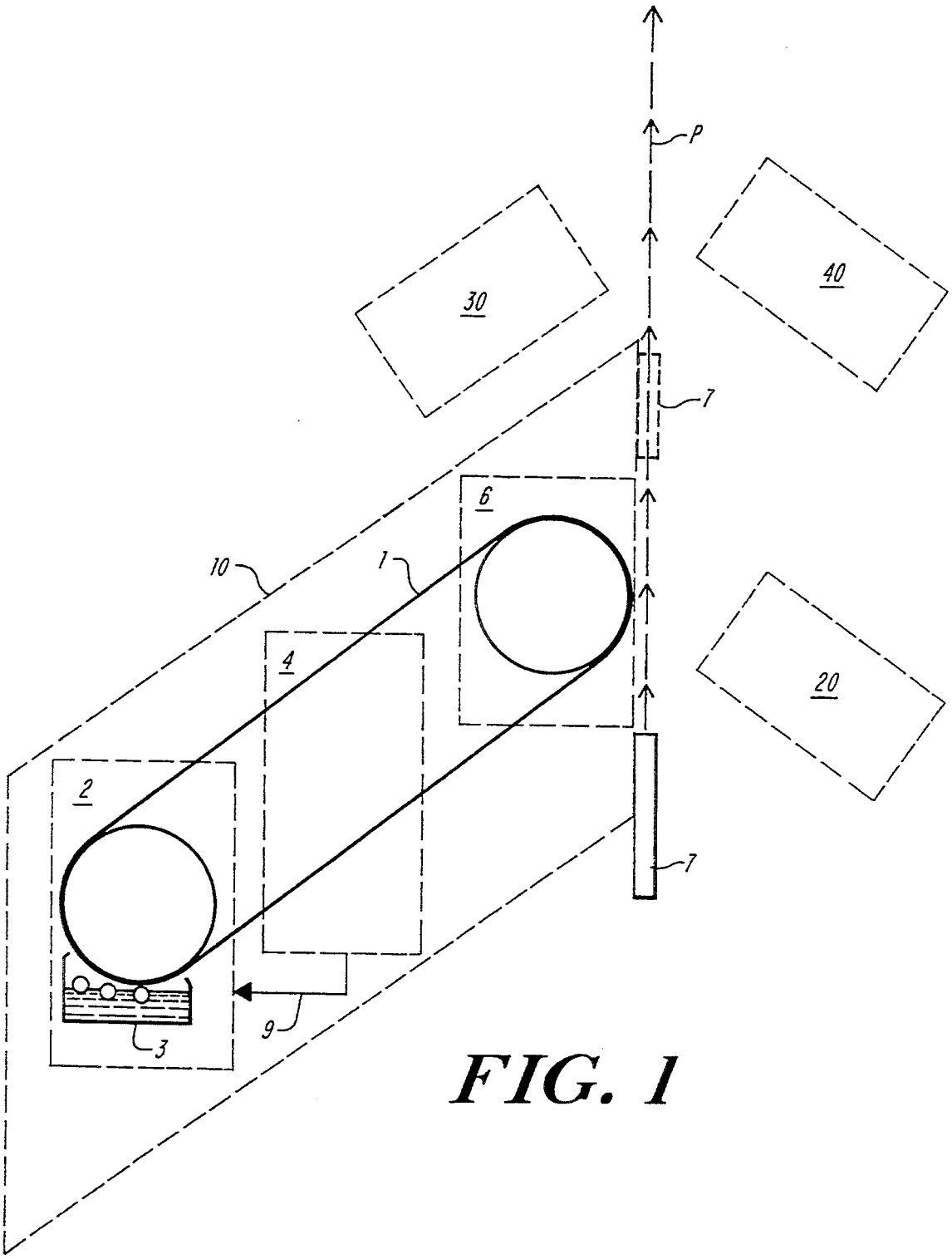
FIG. 1 is a simplified schematic diagram of a print system of the present invention.

A print system 10 according to the present invention includes a single imaging member 1, shown as a belt in FIG. 1, which passes in an endless loop through three distinct stations for forming, conditioning and transferring a toned image carried by the belt. In the first section, image formation section 2, a latent charge image is formed on the belt, and is toned by a liquid development unit 3. The belt then passes through an image conditioning section 4 where its temperature is raised and carrier is extracted from the toned image and returned to unit 3. As described further below, the liquid toner is specially compounded such that the conditioned image on the belt is a friable image of fine powder. Recovered toner components, primarily the carrier fluid, are returned to the imaging section 2 along return 9. The belt then passes to a transfer section 6, where the heated powder image is transferred to a final print image receiving member 7. Member 7 may be a sheet or a continuous web, or as explained more fully below, may be an article, such as a can, box, package or tile which requires printed text or graphics. Similarly, the system may include other units 20, 30, 40 identical to system 10, which are arranged about the transport path P of receiving member 7, to print additional colors, or to print on the opposite side of member 7. For example, a single-pass four-color, two-sided printing system would have eight such units 10, . . .80, four on each side of the path, of which only the first few are shown in FIG. 1.

Figure 2:
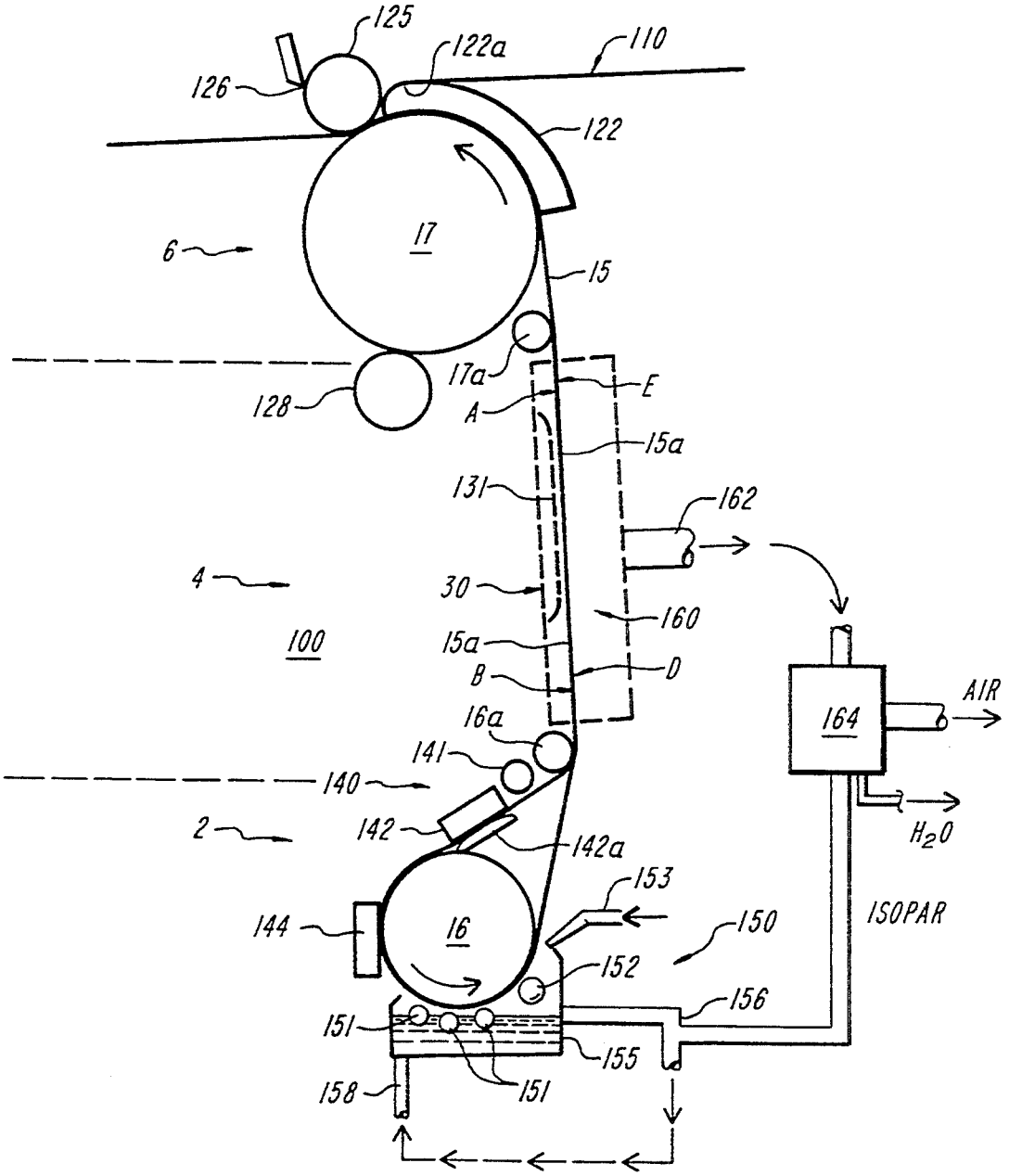
FIG. 2 illustrates a preferred embodiment of the invention of FIG. 1.

A preferred embodiment 100 of system is illustrate in FIG. 2 and uses a dielectric imaging belt 15 that is charged by a charge transfer print cartridge 144. The mechanical layout of this system bears many points of similarity to that of a powder-toned printing system described in commonly-owned U.S. Pat. Nos. 5,012,291 and 5,103,263, in that the image-forming and image transfer stations are located at opposite ends of a closed loop belt, with pre-heating effected at an intermediate portion, and in the preferred embodiment the intermediate portion effects this pre-heating by heat exchange between two different portions of the imaging belt. The reader is referred to those two patents for details of such a belt system and the construction of inextensible and elastomeric belts of suitable imaging properties and capacity. Those two patents are hereby incorporated by reference herein in their entirety, although as will be apparent from the discussion below, the use of liquid toner in the present invention allows, but does not require, some simplification in the belt structure.

The charge retaining imaging belt 15 shown in FIG. 2 may be photoconductive or simply dielectric, and it receives a patterned charge image from imaging module 144 and tones that image in a liquid toning unit 150. Toning unit 150 comprises a housing 155 holding a reservoir of liquid toner, several counter-rotating toner applicator rolls 151 which apply liquid toner to the rotating belt across a small bias field in a gap of approximately one-half millimeter. A squeegee roll 152, air knife 153, or both remove excess toning liquid. The toning unit is maintained at a slight negative pressure to prevent release of fumes, and a circulation pump operates continuously between an outlet 156 and an inlet 158 to keep toner particles uniformly suspended in the carrier. After passing through unit 150, the portions of the belt charged by the print cartridge or imaging module have a thin film liquid toned image thereon, which is then carried by the belt to the image conditioning section 4.

Looking ahead briefly, the belt 15 next carries the toned image into an enclosure 160 where it is heated to drive off the liquid carrier, leaving a dried toner image, and this image travels to and is transferred, or "transfused", by hot pressure contact at the upper roll 17. Thus, the three sections 2, 4, 6 of FIG. 1 correspond to three distinct states (in the physico-chemical sense) of the toned image or its components. The surface properties of the single image receptor belt and toner properties are correspondingly particularized.

Initially, in the imaging/toning section 2 the image consists of pigment/binder particles and liquid carrier. The liquid forms a thin film on the belt, and serves to efficiently and uniformly transport toner particles to charged imaging sites of the latent image. Unlike the case of powder toning described in the aforementioned co-owned patents, it is not necessary for the belt to have a hard surface, since there is no direct pressure exerted on the belt surface that might embed toner particles. Thus, section 2 imposes no significant constraints on the imaging belt and toner beyond those of conventional elements.

In section 4, heat is applied to the image residing on the belt, and carrier liquid from the toner is driven off. In this section, a very high degree of carrier drive-off is preferably effected, and both the belt and the toned image are subjected to heating. Suitable carriers for liquid toning may be selected from the Isopar series of light paraffin mineral spirits marketed by Exxon, generally from among the Isopar G to Isopar L weight series, and the requirements of section 4 impose limitations on both the belt and the toner.

First, unlike conventional emulsion-like toners,the toner particles are selected to be a thermoplastic material that is non-swelling and essentially insoluble in the Isopar carrier. This assures that the wet image, rather than increasing its viscosity in section 4 and retaining carrier, dries to a friable powder image. Suitable insoluble and non-swelling toner particle materials and methods of making suitable toners are disclosed, for example, in U.S. Pat. Nos. 5,069,995 and 5,045,425 of Ronald Swidler. Second, the materials of belt 15 are formed of an Isopar-resistant material, such as a fluorosilicone material. A hard or highly cross-linked surface layer as disclosed in U.S. Pat. No. 5,012,291 may be used as a barrier layer to minimize exposure of the belt to carrier.

Thus both the belt and toner must have special properties for the operation of section 4.

Finally, in section 6, the dry powder image is transfused in a heat-softened state to the receiving member. Thus, the carrier changes state from liquid to vapor phase in section 4, while the powder changes or has changed its state, substantially softening or even attaining its glass transition temperature $T_G$ under the pressure transfuse operation of section 6. For most effective operation of this section, toner image release is achieved by requiring that the belt surface have a low surface free energy, so that the heated image is released as the tacky softened toner contacts the image receiving sheet or article 7, and also by requiring that the belt have a sufficient elastomeric softness to fully conform to the receiving surface. As set forth in the above-referenced commonly-owned patents, a 0.05 mm thick layer of a twenty to fifty Shore A durometer, overcoated with a thinner, harder surface layer, has been found serviceable for hot transfuse imaging onto fiber-based papers.

It should be noted that because the image is not originally a powder image but a liquid one, clumping of particles is not a problem, and the component of thermoplastic material used in forming toner particles for transfuse imagery may be selected to have a quite low softening range, preferably in the range of approximately 80°–100° C. This third section thus relaxes one constraint on the toner composition, allowing operation with a low-fusing composition, a feature which can produce significant energy savings. Furthermore, by employing a surface coating with a low surface free energy, under approximately twenty ergs/cm$^2$, the surface does not wet and relatively little of the carrier fluid is carried out of the first, toning, section 2. A fluorosilicone belt coating is presently preferred, and is selected to be non-swelling in the Isopar solvent carrier.

Returning now to a detailed description of FIG. 2, after toning in section 2, the liquid toned image is then carried by the belt into an enclosure 160 in which heat is applied to drive off the carrier and convert the toned image to a dry image. Preferably the enclosure 160 is maintained at a slight negative pressure, so that carrier fumes do not escape. The Isopar vapor is then condensed in a condenser 164 and, after gravity separation and removal of the condensed water, is returned to the toning unit 150. The condenser 164 may comprise an active cooling unit, i.e., a refrigeration-type compressor of heat exchange fluid, with the vapor condensing on a set of finned condensation plates cooled by the fluid. The condensed carrier being cooled down, its return to the toner reservoir maintains the toner temperature quite low.

In the illustrated embodiment, heat for vaporizing the Isopar carrier is provided to the carrier removal section 4 by a heat exchange unit, illustratively implemented by a platen or back plate 131made of non heat conductive material and having low thermal mass, which urges the back of the belt 15 that is returning from the transfuse station 6 against the back of the image-bearing portion of the belt. Additional heat may be provided by a heater mounted in or near platen 131. The heat exchanger may take other forms than that illustrated, and may be a contact heat exchange member located between the front and back portions of the belt for conducting heat between them. One such heat exchanger may be implemented, for example, by a series of thin shelled heat conductive rollers contacted on diametrically opposite sides by the counter-moving portions of the belt.

The primary value of a heat exchanger, to prevent waste of heat energy as the belt shuttles between different temperatures, is realized when high imaging rates are employed. Thus in an embodiment of an imaging or printing system designed for lower speed printing, the heat exchanger may be entirely dispensed with, and replaced by a simple heated platen or radiant heater, without departing from the spirit of the invention disclosed herein. However, in its preferred embodiment, heat for effecting the carrier phase change in section 4 is provided by the portion of the belt returning from the transfuse nip, and the system prints with a substantial belt speed, of 25–500 feet per minute, to undergo a self-induced fast thermal cycling as it moves between the image-forming section 2 and the image-transfer 6.

Continuing with a description of FIG. 2, as the belt passes through the heated image conditioning chamber 160, the Isopar carrier is entirely driven off, leaving a dry but captive powder image on the warmed belt. Thus the belt presents a heated powder image as it reaches the upper roller 17. There, the belt is pressed into contact with an image receiving member, illustratively a paper web 120, to which the powder image is simultaneously transferred and fused. The powder is heated above its glass transition temperature, so it is tacky when pressed, and flows into the receiving sheet, firmly and uniformly adhering to the image areas. Because of the relatively low thermal mass of both the belt and the toner image it carries, it is desirable to heat the receiving member before it contacts the belt. In the FIG., this is accomplished by drawing the sheet 120 over a heated face 122*a* of a heater 122; heater 122 may also heat the roller 17, or internal heaters may do so. Image transfer occurs at the nip between rollers 125 and 17.

In the illustrated embodiment, a scraper 126 maintains the pressure roller 125 clean, and a cleaner assembly 128 having an absorbent or adhesive surface contacts the belt 15 to pick up any untransferred residual toner, so that the portion of the belt 15*a* leaving the roller 17 is clean and ready for further imaging operations. In practice, virtually one hundred percent of the toner is transferred to the receiving sheet, so that the scraper and cleaner assembly serve primarily to remove paper dust and the like from the belt and roller. Knee rollers 17*a*, 16*a* position the counter-moving portions of the belt 15*a*, 15*b* in heat-exchange contact.

After moving through the heat exchange region, the cleaned and cooled belt portion 15*a* passes on to an electrostatic imaging area 140 where a corona discharger, e.g., a corona rod 141, erases the residual belt surface charge distribution. The belt then passes to one or more controllable print heads 142, 144 which selectively deposit an imagewise charge distribution on the moving belt so that toner next applied by applicator 108 will adhere to the belt with a spatial distribution corresponding to the desired image. In the prototype embodiment, the printhead 144 is a charge transfer printhead of the general type shown in U.S. Pat. No. 4,160,257 and later patents. Printheat 144 may, however, comprise an ion-flow cartridge, an electrostatic pin array or other latent-image charge applying means, or in the case of a photoconductive belt, may comprise a laser scanning module or LED array to selectively discharge a uniform potential which has been previously established, for example, by the corona rod 141.

The two latent image depositing printheads 142, 144 illustrate two different approaches to mounting a printhead in relation to the belt. Printhead 144 is opposed to the drum 6, creating an image deposition geometry similar to that of existing dielectric drum-based systems presently on the market. Printhead 142 is positioned opposite an anvil 142*a* against which the belt is urged. Anvil 142*a* is shaped to provide a desired surface flatness, or a specific curvature selected in order for the belt to receive the charge pattern formed by printhead 142 without distortion. This latter construction reveals that the described dielectric belt system is adapted to generate latent charge images by the placement of plural light-emitting or charge transfer printheads at arbitrary positions along the belt ahead of the toner applicator 150. In practice a single printhead, e.g., printhead 144, is sufficient for single-tone or single-color printing, and may even be used to form multicolor images by depositing an extended range of charge potentials, and biasing the toning reservoirs to apply different color toners to different potential regions of the belt.

One aspect of the belt construction which is important to the operation of the printing apparatus relates to the toner pick-up and release characteristics of the belt. These attributes will be discussed with reference to the just-mentioned electrographic printhead structure, which, in accordance with general principles known in the art, operates by depositing a latent image charge formed by projection of charge carriers onto a dielectric member such that a charge of up to several hundred volts is deposited at a point of the member for attracting toner particles to the dielectric member and developing a visible image.

For operation with such a print cartridge, applicant has employed a belt with a capacitance of approximately 125 to 225 pf/cm$^2$, and considers a preferred range for other common charging and toning systems to be generally in the range of 50 to 500 pf/cm$^2$. For certain systems, such as one with a stylus-type charging head, a higher belt capacitance of approximately 1000 pf/cm$^2$ may be desired, while for other systems operation with a belt capacitance as low as 10 pf/cm$^2$ may be feasible. The construction of a preferred belt having a capacitance of 125–225 pf/cm$^2$ falling within such capacitance range is discussed in greater detail below, following consideration of toner release characteristics.

Full transfer is achieved by providing an elastomeric layer of low-surface energy and of sufficient softness to conform to the print object, so that when the toner is heat-softened or melted, and mechanical pressure is applied, the toner is fully transferred to a paper or other material. A surface formed of a low surface free energy material advantageously prevents excessive carrier in its liquid state from remaining on or sticking to the belt surface. This assures that the belt does not retain toner in the absence of the applied latent image charge, or retain toner at the transfuse section 6 in the presence of the mechanical adhesion or "wicking" of the viscous heated toner to paper. It also limits the wetting that can occur in the development section 2, and since the toner particles are also insoluble and non-swelling on the carrier, little Isopar is transported into the heat exchange/drying section 4, either by the belt or the toner particles.

By way of example, suitable elastomeric properties of the belt may be obtained with an elastomeric layer approximately 0.05 mm thick of Isopar-resistant rubber of a 30 Shore A durometer formed on a KAPTON or other inextensible belt body.

Other suitable materials for the inextensible portion of the belt substrate may include 0.05 mm thick films of Ultem, or other relatively strong and inextensible web materials such as silicone-filled woven NOMEX or KEVLAR cloth, capable or operating at temperatures of up to approximately 200° C. For a direct belt-imaging construction, suitable conductive material may be included in or on the substrate layer to control charging and provide a ground plane. Suitable elastomeric layer materials may include silicone rubbers, fluorosilicones, fluoropolymers such as VITON, and other moderately heat-resistant materials having a hardness preferably in the range of about 20–50 Shore A, and a resistance to the selected toner carrier. Because the belt is not subjected to a pressure nip at any point where dry toner powder is present,the hard coating described in the aforesaid patents is not essential, although it may be expected to enhance belt lifetime, and improve Isopar resistance.

As more fully described in the above mentioned co-owned patents, the belt may also have its photoconductive, dielectric and/or hardness properties enhanced by use of one or more filler materials in the elastomeric layer. For example, finely divided metal powders may be employed in a low concentration to greatly increase the belt capacitance, without significantly affecting its conductivity; or photoconductive powders may be added to adapt the belt to a light-imaging process.

It will be appreciated that the foregoing system achieves numerous advantages over a dry-only or liquid-only printing system. The heat-softened toner image is transferred to a final substrate at a relatively low contact pressure, typically not over around 100 psi, and produces archival quality adhesion to the print. Further, the use of liquid toner for the initial toning step allows much finer imaging than conventional dry powders, with an essentially dust-free process. In the embodiment illustrated for printing on a paper or fibrous surface, the thin elastomer provides substantially complete image transfer with little deformation, and may operate with a toner having a one to two micrometer mean particle size, thus providing high quality imaging and exceptionally fine resolution. Although some high resolution liquid toning processes have employed semi-transparent toner particles, the present invention preferably employs fine toner particles that are opaque and non-swelling.

This completes a description of a representative embodiment of a print system, or sub-unit of a multi-color print system, in accordance with the illustrated embodiment. Its operation and salient aspects being thus disclosed, variations and modifications will occur to those skilled in the art, and all such variations are intended to be within the scope of the invention, as set forth in the claims appended hereto.

What is claimed is:

1. A system for printing on a substrate, such system comprising an endless belt cyclically travelling around a roller mechanism that defines spatially separated successive first, second and third sections of said system a liquid toning unit in said first section for applying to the belt a liquid toner comprised of a liquid carrier and toner particles suspended in the carrier, for developing a latent charge image into liquid toned visible image at said first section means at said second section for driving off substantially all of said carrier from the visible image to leave a powder toner image resisting on the belt, and means for transfusing the powder toned image onto the substrate at said third section, the roller mechanism cyclically returning the belt from said third section to said first section for receiving a further liquid toned image.

2. A system according to claim 1, wherein the means for driving of substantially all of said carrier includes a heat exchanger for exchanging heat between a portion of said belt traveling from the third section to the first section, and a portion of the belt traveling from the first section to the third section.

3. A system according to claim 1, wherein the liquid carrier undergoes a phase change at said second section.

4. A system according to claim 3, wherein the toner particles have a changed state at said third section.

5. A system according to claim 1, wherein the belt has a surface that is non-wetting in the liquid carrier thereby limiting transport of carrier into said second section.

6. A system according to claim 5, wherein the belt has at least a surface portion formed of fluorosilicone material.

7. A system according to claim 2, wherein the roller mechanism drives the endless belt at a speed between approximately twenty-five and five hundred feet per minute.

8. A system according to claim 1, wherein the endless belt has a low surface energy coating.

9. A printing system comprising an endless belt having a dielectric image surface a first section for applying and liquid toning an image on said imaging surface a third section for heating and transferring the toned image to a receiving member, the endless belt being movable from said first section to said third section to receive and transfer said image, and a second section, located between said first section and said third section for heating a portion of the endless belt to convert a liquid toner image to a captive dry powder image on the belt for transfusing by said third section.

10. A printing system according to claim 9, wherein said heat exchange section includes an enclosure, and vaporizes carrier from the image, and further comprising means communicating with such enclosure for condensing vaporized carrier and adding the condensed carrier to liquid toner at said first section.

11. A printing system according to claim 9, wherein the third section heats the captive dry powder image to a softened state.

12. A printing system according to claim 9, wherein the first section applies a liquid toner comprised of a liquid carrier and a plurality of thermoplastic particles in the carrier, the thermoplastic particles being insoluble and non-swelling in the carrier.

13. A printing system according to claim 12, wherein the particles have a mean particle size in the range of approximately one to three microns diameter.

14. A printing system according to claim 13, wherein the particles are opaque.

15. A printing system according to claim 9, wherein the first section applies a latent charge image to the endless belt.

16. A printing system according to claim 15, further comprising at least one charge transfer print cartridge for applying said latent charge image.

17. A printing system according to claim 9, comprising a plurality of endless belts, each one being movable between a respective first section and a respective third section through a respective second section that applies heat and converts a liquid toner image to a captive dry powder image on the belt, the respective third sections being located along a transport path such that each belt transfers its image to a common receiving member on the transport path.

18. A printing system according to claim 17, wherein each endless belt carries a different color image to transfer to the receiving member.

* * * * *

UNITED STATES PATENT AND TRADEMARK OFFICE

CERTIFICATE OF CORRECTION

PATENT NO. : 5,414,498
DATED : May 9, 1995
INVENTOR(S) : William R. Buchan et al.

It is certified that error appears in the above-indentified patent and that said Letters Patent is hereby corrected as shown below:

At column 3, line 51, replace "illustrate", with --illustrated--.

At column 5, line 56, replace "131made", with --131 made--.

At column 6, line 60, replace "Printheat", with --Printhead--.

At column 9, line 1, replace "resisting", with --residing--.

Signed and Sealed this

Sixth Day of February, 1996

Bruce Lehman

*Attest:*

BRUCE LEHMAN

*Attesting Officer*

*Commissioner of Patents and Trademarks*